US008806808B2

(12) United States Patent
Joray

(10) Patent No.: US 8,806,808 B2
(45) Date of Patent: Aug. 19, 2014

(54) SLIDING WINDOW OR SLIDING GLASS DOOR

(75) Inventor: Eric Joray, St-Aubin (CH)

(73) Assignee: Orchidees Constructions S.A., St-Aubin-Sauges (CH)

( * ) Notice: Subject to any disclaimer, the term of this patent is extended or adjusted under 35 U.S.C. 154(b) by 77 days.

(21) Appl. No.: 12/998,390

(22) PCT Filed: Jun. 6, 2010

(86) PCT No.: PCT/IB2010/052762

§ 371 (c)(1),
(2), (4) Date: Apr. 12, 2011

(87) PCT Pub. No.: WO2011/001321

PCT Pub. Date: Jan. 6, 2011

(65) Prior Publication Data

US 2011/0197515 A1 Aug. 18, 2011

(30) Foreign Application Priority Data

Jun. 29, 2009 (EP) ..... 09164072

(51) Int. Cl.

| | |
|---|---|
| ***E05D 13/00*** | (2006.01) |
| ***E05D 15/06*** | (2006.01) |
| ***E06B 3/46*** | (2006.01) |
| ***E06B 3/263*** | (2006.01) |

(52) U.S. Cl.

CPC ..... *E05D 15/0686* (2013.01); *E05D 15/0665* (2013.01); *E06B 3/4609* (2013.01); *E06B 3/26347* (2013.01); *E05Y 2900/132* (2013.01); *E05Y 2800/672* (2013.01)

USPC ..... 49/425

(58) Field of Classification Search

CPC ..... E05D 15/0665; E05D 15/0686

USPC ..... 49/425, 420, 413, 404, 410, 61, 63, 49/125, 411, 209, 504; 16/91

See application file for complete search history.

(56) References Cited

U.S. PATENT DOCUMENTS 2,274,730 A * 3/1942 Owen ..... 49/425
3,320,700 A * 5/1967 Bohn ..... 49/404

(Continued)

FOREIGN PATENT DOCUMENTS

CH 390511 4/1965
CH 696 444 A5 6/2007

(Continued)

*Primary Examiner* — Katherine Mitchell
*Assistant Examiner* — Scott Denion
(74) *Attorney, Agent, or Firm* — Krieg DeVault LLP; Clifford W. Browning

(57) ABSTRACT

The sliding panel (1) comprise on at least one of sides thereof in the direction of the movement thereof, the reinforcing member (4) consisting of two aluminum sections (4*a* and 4*b*) connected by a polyamide thermal break (4*c*) and having two edges (4*d* and 4*e*) that define the longitudinal groove (22) having the same width from one end of the member (4) to the other end thereof. The guides (10) and the longitudinal inverted channel section (11) are placed in stationary positions on the benches (8 and 9) belonging to the profile sections of the frame (2) of the sliding window or sliding glass door. Each guide (10) comprises, in the center of the block (12), the vertical rod (20) having, on the top end thereof, ball bearings (21) that are located exactly between the edges (4*d* and 4*e*) and are located in the longitudinal channel (22) through which the panel (1) is guided in the movements thereof.

9 Claims, 3 Drawing Sheets

(56) References Cited

U.S. PATENT DOCUMENTS

| | | | | | |
|---|---|---|---|---|---|
| 4,202,137 | A | | 5/1980 | Randall | |
| 4,234,996 | A | * | 11/1980 | Jentsch | 16/52 |
| 4,791,757 | A | * | 12/1988 | Orlando | 49/360 |
| 4,936,049 | A | * | 6/1990 | Hansen | 49/209 |
| 6,926,342 | B2 | * | 8/2005 | Pommeret et al. | 296/155 |
| 7,653,966 | B2 | * | 2/2010 | Quinn et al. | 16/96 R |
| 2010/0242365 | A1 | * | 9/2010 | Langner et al. | 49/130 |

FOREIGN PATENT DOCUMENTS

| | | | |
|---|---|---|---|
| EP | 1 353 034 | A2 | 10/2003 |
| WO | 94/17275 | | 8/1994 |
| WO | WO 94/17275 | A1 | 8/1994 |
| WO | WO 2010024703 | A1 * | 3/2010 |

* cited by examiner

FIG.4
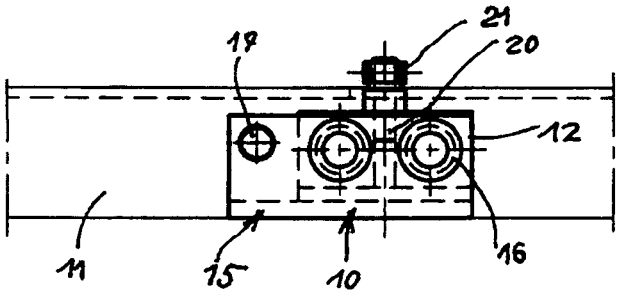
FIG.5
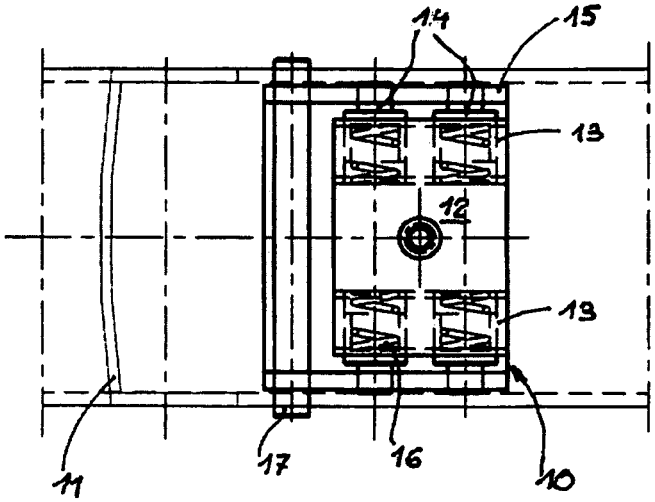
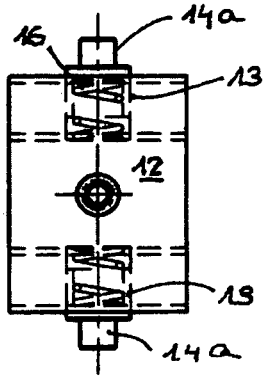
FIG.3

SLIDING WINDOW OR SLIDING GLASS DOOR

TECHNICAL FIELD

The present invention relates to a sliding window or sliding glass door having a fixed frame and, in this frame, at least one glazed panel which cooperates with guide means associated with the frame and guiding the panel so as to move along the frame.

STATE OF THE ART

Windows or glass doors of this type are already known, in particular by the disclosure of patent CH 696 444, CH 390 511 or the international publication WO 94/17275, the latter being by the same applicant. The current architectural trend in the area of windows demands large glazing dimensions as well as high levels of acoustic and thermal performance. In order to meet these requirements the glazing units are becoming larger and larger and heavier and heavier. Thus, this trend leads to an increase in handling forces during opening and closing of the window. One of the additional difficulties resides in guiding the large-dimension panels which frequently have a natural curvature originating in the manufacturing process. Some known embodiments, and particularly those cited above, include members provided with guide rods associated with the moveable panels and sliding in channels or grooves in the frame. For large-dimension glazing units, these devices are deficient because they do not allow correction for the natural curvatures of the glass.

DISCLOSURE OF THE INVENTION

The aim of the invention is thus to propose an arrangement for sliding windows or sliding glass doors which overcomes the stated deficiencies. To this end, a sliding window or sliding glass door is proposed having a fixed frame and, in this frame, at least one glazed panel which cooperates with guide means associated with the frame and guiding the panel so as to move along the said frame, in which the said panel is equipped on at least one of its lower longitudinal borders with a rigid reinforcing member which has, projecting from this border, two opposing symmetrical edges defining a longitudinal channel in this reinforcing member, and in which the said guide means have one or several fixed guides equipped with centering elements engaged in the said channel, characterized in that the said guide or guides is or are interposed between slide support units with rollers associated with a lower side of the frame and forming part of the said guide means.

In one advantageous configuration of the invention, each rigid reinforcing member of a panel is equipped with support strips disposed longitudinally, the slide support units with rollers being prefabricated composite devices with each comprising a pair of rollers on which the said support strips roll, these support units being arranged to support the said panel or panels.

In one configuration of the invention, the said reinforcing member of each panel has two metal right-angled profiled part segments having opposing profiles and connected to each other in parallel positions by means of one or several connection members in the form of blades joining coplanar portions of the mutually facing right-angled profiled parts to each other while leaving free portions of the said profiled parts forming the said edges and between which centering elements are engaged, each panel having one or several glass plates engaged and held in place between mutually parallel portions of the said right-angled profiled parts.

The said lower side of the frame can have a longitudinal covering profiled part with an inverted U-shaped profile placed on two seats of an assembly of two profiled parts forming the structure of the said lower element of the frame, the guides being fixedly attached to this covering profiled part by transverse pins and these pins being dimensioned so that the placement of the covering profiled part between parallel sides, each provided with an internal longitudinal rib of the said profiled part assembly, permits longitudinal guidance of the panel in its plane of symmetry during sliding.

The said block or blocks can be made of aluminum.

In one configuration of the invention, each of the said guides has a block mounted on springs oriented laterally in a flat-bottomed support member, this block being equipped with a vertical rod which is held by the said springs in the vertical plane of symmetry of the panel and engaged in the said channel.

The said rod can support a ball bearing with a vertical axis engaged between the said edges and acting as a centering element.

The said springs can consist of one or two pairs of antagonistic springs engaged in coaxial cylindrical housings of the block and being supported on cylindrical slides having bosses embedded in the flanks of the flat-bottomed support member so as to control limited lateral deflection of the block.

The dimensioning of the guide can be such that the lateral deflection reaches 2 to 3 mm.

BRIEF DESCRIPTION OF THE DRAWINGS

Merely by way of example, an embodiment and several variations of the object of the invention will be described hereinunder with reference to the attached drawing in which:

FIGS. 3 and 4 are respectively a top plan view and an elevational view of a guide incorporated into the frame of the window of FIGS. 1 and 2, FIG. 5 is a top plan view of another variation of the guide of FIGS. 3 and 4.

DETAILED DESCRIPTION OF EMBODIMENTS OF THE INVENTION

Figure 1:
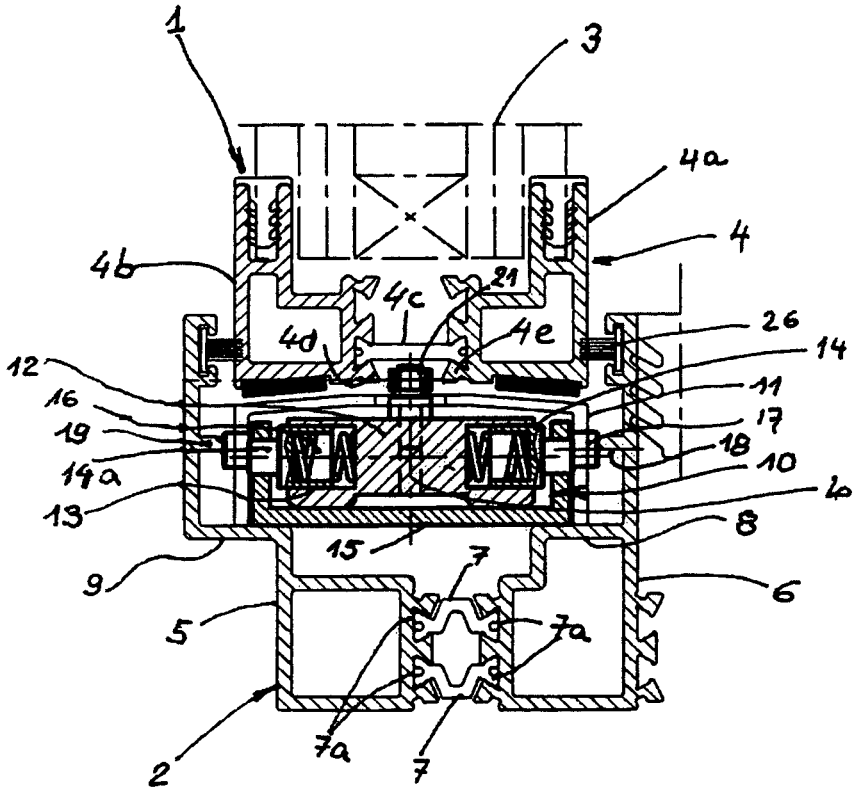
FIG. 1 is a cross-sectional view in a vertical plane of the lower part of a sliding window constituting the embodiment of the invention, given by way of example.

FIG. 1 shows a partial view of the rectangular glazed panel 1 of a sliding window mounted in a fixed frame 2. The figure shows the bottom of the window, the glazed assembly 3 of which is equipped with a rigid reinforcing member 4 formed from metal profiled parts (4*a* and 4*b*). The glazed assembly 3 can have any of the various following structures: one or several plates of glass, plates spaced apart or placed side by side, of the same structure or of different structures, etc. The member 4 may be fitted to only the lower border of the glazing unit 3 but can also surround it entirely or only on its upper and lower borders. It is formed from segments of straight aluminum profiled parts. It will be noted that the reinforcing member 4 has in particular two straight segments 4*a* and 4*b* of profiled parts in the general form of a right angle, which are connected to each other by a polyimide thermal break 4*c*.

Furthermore, portions of the profiled parts 4*a* and 4*b* which extend projecting downwards below the piece 4*c* form edges 4*d* and 4*e* which extend facing each other and defining between them a channel, the purpose of which will prove to be essential for the operation of the device of the invention.

The panel 1 slides longitudinally, i.e. in the direction perpendicular to the plane of the drawing in the frame 2, the arrangement of the lower side of which is shown in FIG. 1. The frame 2 will also be formed of segments of straight profiled parts, preferably of aluminum, these segments of profiled parts being assembled as a quadrilateral. Thus, the lower side of the frame 2 has two profiled part segments 5, 6 in the general form of a right angle, connected in fixed positions, which are parallel to each other in terms of their flanks oriented in the plane of the window but opposite in terms of their right-angled flanks which are oriented facing each other. Connection strips 7 of synthetic material, which are engaged in grooves 7*a* in the inner borders of the profiled part segments 5 and 6, ensure assembly thereof.

The profiled parts 5 and 6 each have, at the base of their parallel flanks, on the inner side, seats 8, 9, these being coplanar in such a way as to serve as a support for two elements which are essential to the device described: on the one hand a series of guides 10 spaced apart along the base of the frame 2 and on the other hand a longitudinal covering profiled part 11 in a U-shape, disposed in an inverted position and extending over the whole length of the frame 2. The guides 10 are prefabricated assemblies designed to increase the quality of the movement of the glazed panels 1 in the frame 2. The guides 10 are illustrated in FIGS. 1 to 5, FIG. 5 illustrating an embodiment variation. Each guide has a rectangular block 12 provided in FIGS. 1 to 4 with four flat-bottomed cylindrical housings 13 aligned two by two transversely (see FIGS. 3 and 4). In the variation of FIG. 5, a single pair of housings 13 is provided. In each of these housings a cylindrical slide 14 is engaged, having an abutment protrusion 14*a* which is embedded in one of the flanks of a U-shaped, flat-bottomed support member 15 freely engaged between the flanks of the profiled part 11 and on the seats 8 and 9. Helical spring elements 16 are placed in a slightly tensioned position between the bottoms of the housings 13 and the slides 14 so that the blocks 12, while being able to move laterally in the support member 15, are held in symmetrical positions with respect to the profiled part 11. Each guide 10 is also fixedly attached to the profiled part 11 by a transverse pin 17, the length of which is precisely adjusted so as to engage without play between two internal longitudinal ribs 18 and 19 on the profiled parts 5 and 6.

Figure 2:
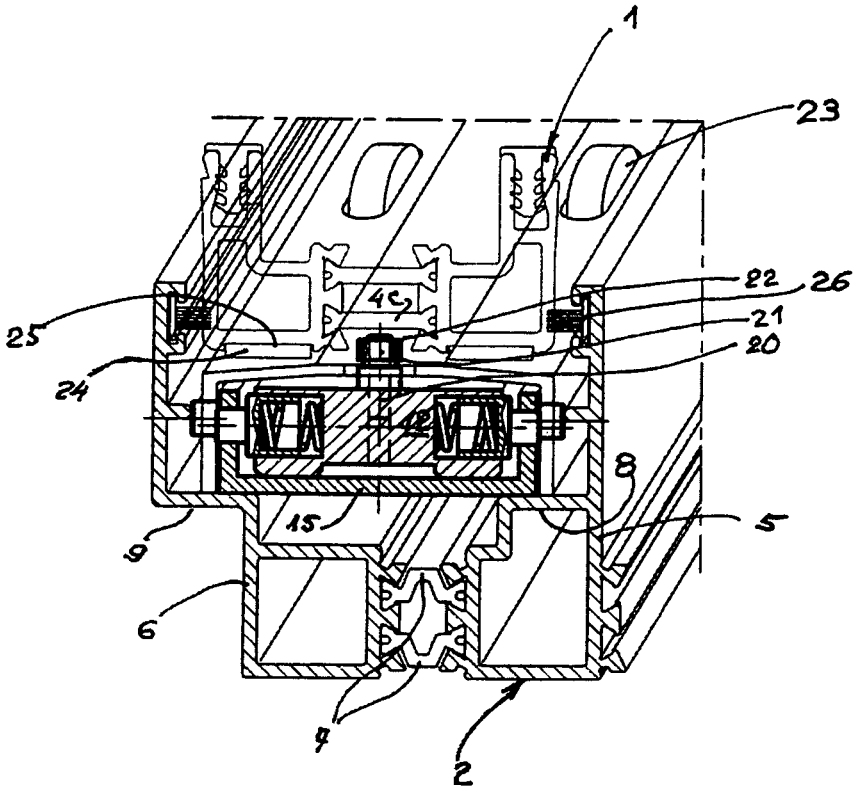
FIG. 2 is an oblique cut-away perspective view of the same part as in FIG. 1 of a window constituting an embodiment variation of the object of the invention.

In order to carry out its guiding role, each of the blocks 12 has, in its centre, a vertical rod 20 equipped at its upper end with a ball bearing 21. As shown in FIGS. 1 and 2, the rod 20 of the guides 10 passes through the covering profiled part 11. It has the ball bearing 21 in a longitudinal channel 22 defined in the reinforcing member 4 of the glazed panel 1 between the edges 4*d* and 4*e* of this member.

Figure 6:
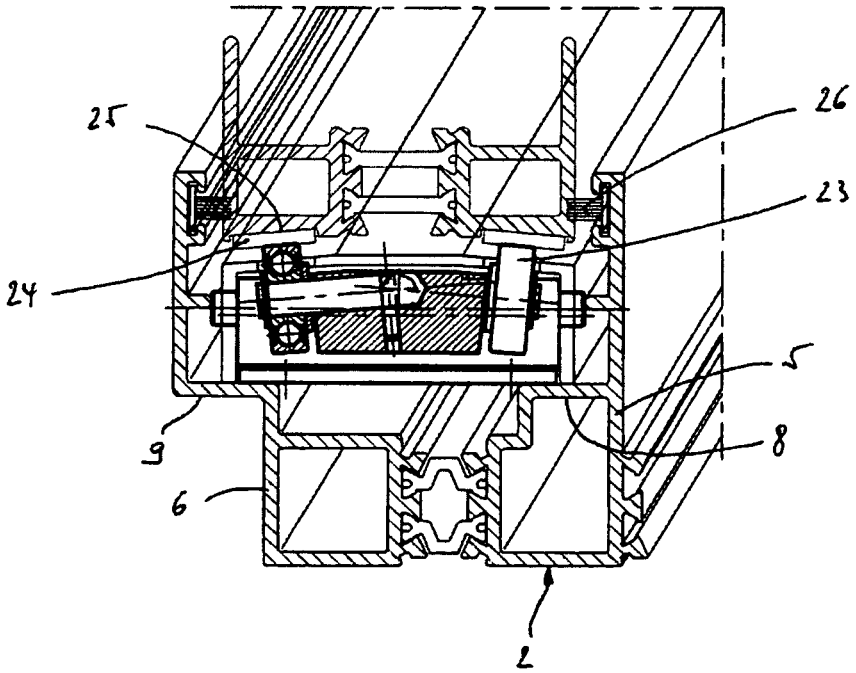
FIG. 6 is a vertical cross-sectional view of the rolling system of the window of FIG. 1.

In the embodiments illustrated in FIGS. 1, 2 and 6, the inverted U-shaped covering profiled part 11 does not serve merely to position the guides 10 but also covers slide supports which will be disposed between the guides 10 distributed along the lower horizontal side of the fixed frame 2. Such supports are described in particular in an earlier European filing no. 08101885.5 by the same applicant. They each have a block of rollers elastically supported on a plate with a fixed base and provided with free rollers such as the rollers 23 (FIGS. 2 and 6). These rollers can roll against the support strips 24 disposed longitudinally in shallow grooves 25 provided in the lower elements of the profiled parts 4*a*, 4*b* of the panel or panels 1 which can move in the frame 2. It will be noted that, in FIG. 2, the support strips 24 and the profile of the grooves 25 are disposed in a single plane, whereas, in the embodiment of FIGS. 1 and 6, the same strips and the same grooves are disposed obliquely. In any case the guides described have shown their practical efficacy in the sense that even very heavy and complex glazed panels can easily be moved by hand.

Finally, attention is drawn to the presence of the brushes 26 (FIGS. 1, 2 and 6) engaged between internal ribs of the frame profiled parts 4 and which have a function of sealing against water and air over the length of the frame profiled part 4.

FIGS. 3, 4 and 5 show concrete examples of the guides described. Since the reference numbers have already been given with respect to FIGS. 1, 2 and 6, it is thus not necessary to return thereto.

The invention claimed is:

1. Sliding window or sliding glass door having a fixed frame and, in this frame, at least one glazed panel which cooperates with guiding members mounted on the frame and guiding the glazed panel so as to move along the said frame in a longitudinal direction, in which the said glazed panel has at least one lower longitudinal border and is equipped on said at least one lower longitudinal border with a rigid reinforcing member which has, projecting from the border, two opposing symmetrical edges defining a longitudinal channel in this reinforcing member, and in which the said guiding members have several fixed guides equipped with respective centering elements engaged in the said channel and being configured so as to permit a lateral deflection of said centering elements inside said channel perpendicular to said longitudinal direction, wherein the said guides are assemblies independent to and intercalated, along the sliding direction of the glazed panel, between slide support units with rollers mounted on a lower side of the frame and forming part of the said guiding members, wherein a lower side of the frame has a longitudinal covering profiled part with an inverted U-shaped profile placed on two seats of an assembly of two profiled parts forming the structure of a lower element of the frame, the guides being fixedly attached to this covering profiled part by transverse pins, these pins being perpendicular to a vertical plane of symmetry of the glazed panel.

2. Sliding window or sliding glass door according to claim 1, wherein each rigid reinforcing member of the glazed panel is equipped with support strips disposed longitudinally, and wherein the slide support units with rollers are prefabricated composite devices with each comprising a pair of rollers on which the said support strips roll, these support units being arranged to support the said glazed panel or panels.

3. Sliding window or sliding glass door according to claim 1, wherein the said reinforcing member of each panel has two metal right-angled profiled part segments having opposing profiles and connected to each other by means of one or several connection members joining coplanar portions of the mutually facing right-angled profiled parts to each other while leaving free portions of the said profiled parts forming the said edges and between which centering elements are engaged, each panel having one or several glass plates engaged and held in place between mutually parallel portions of the said right-angled profiled parts.

4. Sliding window or sliding glass door according to claim 1, wherein each of the said guides has a block mounted on springs oriented laterally in a support member with a flat bottom, this block being equipped with a vertical rod which is held by the said springs in the vertical plane of symmetry of the glazed panel and engaged in the said channel.

5. Sliding window or sliding glass door according to claim 4, wherein the said rod supports a ball bearing with a vertical axis engaged between the said edges and acting as a centering element.

6. Sliding window or sliding glass door according to claim 4, wherein the said springs consist of one or two pairs of antagonistic springs engaged in coaxial cylindrical housings of the block and being supported on cylindrical slides having bosses embedded in the flanks of the flat-bottomed support member so as to control limited lateral deflection of the block.

7. Sliding window or sliding glass door according to claim 6, wherein the dimensioning of each of the said guides is such that the lateral deflection reaches 2 to 3 mm.

8. Sliding window or sliding glass door according to claim 3, wherein the transverse pins are dimensioned so that the placement of the covering profiled part between parallel sides each provided with an internal longitudinal rib of the said profiled part assembly permits longitudinal guidance of the panel in its plane of symmetry during sliding.

9. Sliding window or sliding glass door according to claim 4, wherein the said block or blocks are made of aluminum.

* * * * *

UNITED STATES PATENT AND TRADEMARK OFFICE

CERTIFICATE OF CORRECTION

PATENT NO. : 8,806,808 B2
APPLICATION NO. : 12/998390
DATED : August 19, 2014
INVENTOR(S) : Eric Joray It is certified that error appears in the above-identified patent and that said Letters Patent is hereby corrected as shown below:

On the Title Page Item (22) should read: PCT Filed: Jun. 18, 2010

Signed and Sealed this
Twenty-fifth Day of November, 2014

Michelle K. Lee

Michelle K. Lee
*Deputy Director of the United States Patent and Trademark Office*